US008047168B2

(12) United States Patent
Hwang

(10) Patent No.: US 8,047,168 B2
(45) Date of Patent: Nov. 1, 2011

(54) CONTINUOUSLY VARIABLE VALVE LIFT SYSTEM FOR ENGINE

(75) Inventor: Yunsung Hwang, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 548 days.

(21) Appl. No.: 12/343,123

(22) Filed: Dec. 23, 2008

(65) Prior Publication Data

US 2009/0293824 A1 Dec. 3, 2009

(30) Foreign Application Priority Data

May 29, 2008 (KR) ..... 10-2008-0050074

(51) Int. Cl.
*F01L 1/34* (2006.01)

(52) U.S. Cl. ..... 123/90.16; 123/90.39

(58) Field of Classification Search ..... 123/90.15, 123/90.16, 90.39
See application file for complete search history.

(56) References Cited

U.S. PATENT DOCUMENTS

2006/0207533 A1* 9/2006 Fujita et al. ..... 123/90.16

FOREIGN PATENT DOCUMENTS

| | | | |
|---|---|---|---|
| JP | 2004-132258 | A | 4/2004 |
| JP | 2005-009487 | A | 1/2005 |
| JP | 2005-140026 | A | 6/2005 |
| JP | 2005-171922 | A | 6/2005 |
| JP | 2005-264840 | A | 9/2005 |
| KR | 10-2008-0018477 | A | 2/2008 |

* cited by examiner

*Primary Examiner* — Zelalem Eshete
(74) *Attorney, Agent, or Firm* — Morgan, Lewis & Bockius LLP

(57) ABSTRACT

A continuously variable valve lift system for an engine may include a driving cam fixed to a camshaft, a control shaft disposed in parallel to the camshaft with a predetermined distance, an upper rocker arm, one end of which is rotatably coupled to the control shaft and the other end of which is slidably contacted to and rotated by the driving cam, lower rocker arm that is selectively pushed by the upper rocker arm and selectively pushes a valve, rocker arm follower slidably coupled to the lower rocker arm and contacting the upper rocker arm, wherein the rocker arm follower transmits an operational force of the upper rocker arm to the lower rocker arm, and a variable mechanism that changes contact point of the rocker arm follower and the upper rocker arm according to rotation of the control shaft.

19 Claims, 8 Drawing Sheets

CONTINUOUSLY VARIABLE VALVE LIFT SYSTEM FOR ENGINE

CROSS-REFERENCE TO RELATED APPLICATIONS

The present application claims priority to Korean Patent Application Number 10-2008-0050074 filed May 29, 2008, the entire contents of which application is incorporated herein for all purposes by this reference.

BACKGROUND OF THE INVENTION

1. Field of the Invention

The present invention relates to a continuously variable valve lift system for an engine, particularly a continuously variable valve lift system for an engine that can adjust opening/closing timings and open/close times of intake/exhaust valves according to rotation of a camshaft.

2. Description of Related Art

According to common actuating mechanism for a valve in the related art, a valve lift was only uniformly formed according to the profile of a driving cam formed on a camshaft, but it was impossible to change the valve lift and duration. Therefore, because an engine worked under a fixed valve lift and duration, it was impossible to improve the engine power and reduce fuel consumption by changing the valve lift and duration.

For this reason, studies for developing valve actuating mechanisms that can adjust the valve lift, open/close times, and opening/closing timings according to driving conditions of the engine has been conducted in recent years. One of the actuating mechanisms is a continuously variable valve lift system (CVVL), which is proposed by the present applicant.

Because the continuously variable valve lift system can adjust opening/closing timings of intake/exhaust valves and valve operations, such as a valve lift, to optimum conditions, depending on working conditions of the engine, it is possible to improve the engine power by increasing the amount of intake under high velocity and high load, and also reduce fuel consumption and exhaust gas by minimizing EGR effect or throttle loss under low velocity and low load.

However, according to continuously variable valve lift systems in the related art, a lot of components were used and the combining structures were complicated. Further, since continuously variable valve lift systems were designed to occupy the upper space higher than the camshaft in the cylinder head of the engine, total height of the cylinder head had to be increased.

Therefore, the entire size of an engine equipped with the continuously variable valve lift system had to be increased, such that the space occupied by the engine in the engine compartment was increased, which made it difficult to set a layout of other devices.

Further, there were a lot of moving components and the operational mechanism was correspondingly complicated, such that it was difficult to precisely and reliably adjust the valve lift and duration and secure sufficient durability for the entire variable mechanism of the engine equipped with the system.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve lift system for an engine that has a compact configuration with reduced number or components and disposed under the camshaft in the cylinder head to simply operate with improved precision and reliability and easily secure durability, and particularly, that makes it possible to improve free of layout in the engine compartment by reducing total height of the cylinder head to decrease the size of the engine.

In an aspect of the present invention, a continuously variable valve lift system for an engine, may include a driving cam fixed to a camshaft, a control shaft disposed in parallel to the camshaft with a predetermined distance, an upper rocker arm, one end of which is rotatably coupled to the control shaft and the other end of which is slidably contacted to and rotated by the driving cam, lower rocker arm that is selectively pushed by the upper rocker arm and selectively pushes a valve, rocker arm follower slidably coupled to the lower rocker arm and contacting the upper rocker arm, wherein the rocker arm follower transmits an operational force of the upper rocker arm to the lower rocker arm, and a variable mechanism that changes contact point of the rocker arm follower and the upper rocker arm according to rotation of the control shaft.

The other end of the upper rocker arm may be elastically supported toward the driving cam by an elastic member.

The other end of the upper rocker arm may be equipped with a roller.

The control shaft may be disposed between the driving cam and the lower rocker arm.

The control shaft may be fastened to and activated by an actuator controlled by a control unit to adjust rotational angle of the control shaft.

A profile determining a high lift and a low lift according to contact with the rocker arm follower may be formed on lower surface of the upper rocker arm.

The variable mechanism may include a control lever, one end of which is fixed to the control shaft and the other end of which pushes the rocker arm follower to change the contact point of the rocker arm follower by operation of the control shaft, and an elastic member that elastically supports the rocker arm follower against the control lever.

The elastic member may include a variable arm rotatably coupled to one end of the lower rocker arm and supporting the rocker arm follower in opposite direction of operation direction of the control lever, the one end of the lower rocker arm being rotatably coupled to the valve.

The rocker arm follower may be rotatably coupled to a rocker arm shaft and the rocker arm shaft is coupled to inclined slot formed through the lower rocker arm so as to permit the rocker arm shaft to move slidably along the inclined slot by the rotation of the control shaft.

The inclined slot may be configured such that upper portion thereof is aligned near or to an axis connecting an end of the lower rocker arm and the control shaft so as to increase relative distance between the connecting shaft and the control shaft to form a high lift, the one end of the lower rocker arm being rotatably coupled to the valve.

Lower portion of the inclined slot may be offset with a predetermined distance from the axis connecting the end of the lower rocker arm and the control shaft so as to decrease the relative distance between the connecting shaft and the control shaft to form a low lift.

The rocker arm follower may be a roller that is rotatably fitted around the rocker arm shaft through a bearing.

The variable mechanism may include a control lever, one end of which is fixed to the control shaft and the other end of which contacts the rocker arm shaft to change position of the rocker arm shaft along the inclined slot by operation of the control shaft so as to change the contact point of the rocker arm follower, and an elastic member that elastically supports the rocker arm shaft against the control lever.

The control lever may be integrally formed with the control shaft and has an arc-shaped protruding surface, which contacts with the rocker arm shaft.

The elastic member may include a variable arm rotatably coupled to the one end of the lower rocker arm and elastically supporting the rocker arm shaft in opposite direction of operation direction of the control lever.

The variable arm may include a movable member telescopically coupled to the one end of the lower rocker arm, one end of the movable member being rotatably fitted around the rocker arm shaft, and an elastic element is disposed between the one end of the lower rocker arm and the movable member so as to support the movable member toward the protruding surface of the control lever.

An arc-shaped holding portion including a receiving portion that holds the control lever therein to maintain contact between the rocker arm shaft and the control lever may be formed on the end of the movable member, wherein the rocker arm shaft passes through the arc-shaped holding portion and rotates with respect to the rocker arm shaft.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Figure 1:
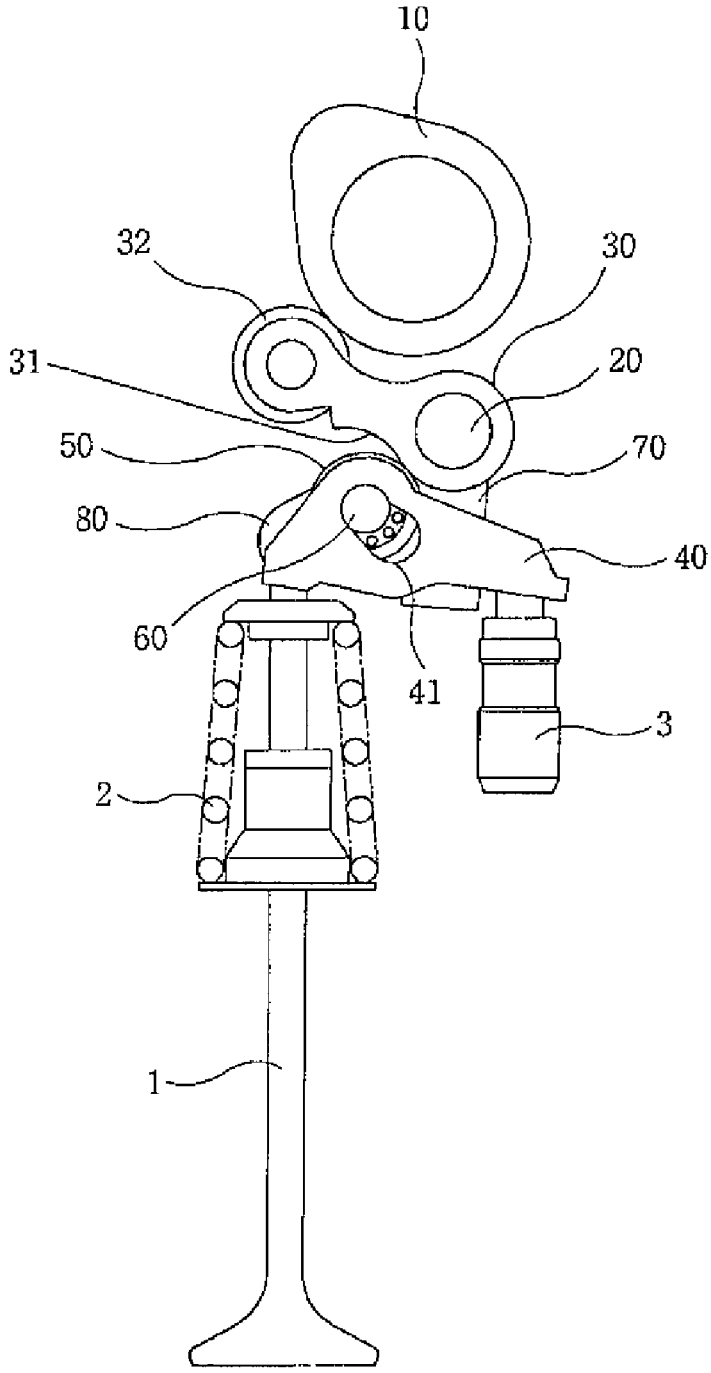
FIG. 1 is a view showing the configuration of an exemplary continuously variable valve lift system for an engine according to the present invention.
Figure 2:
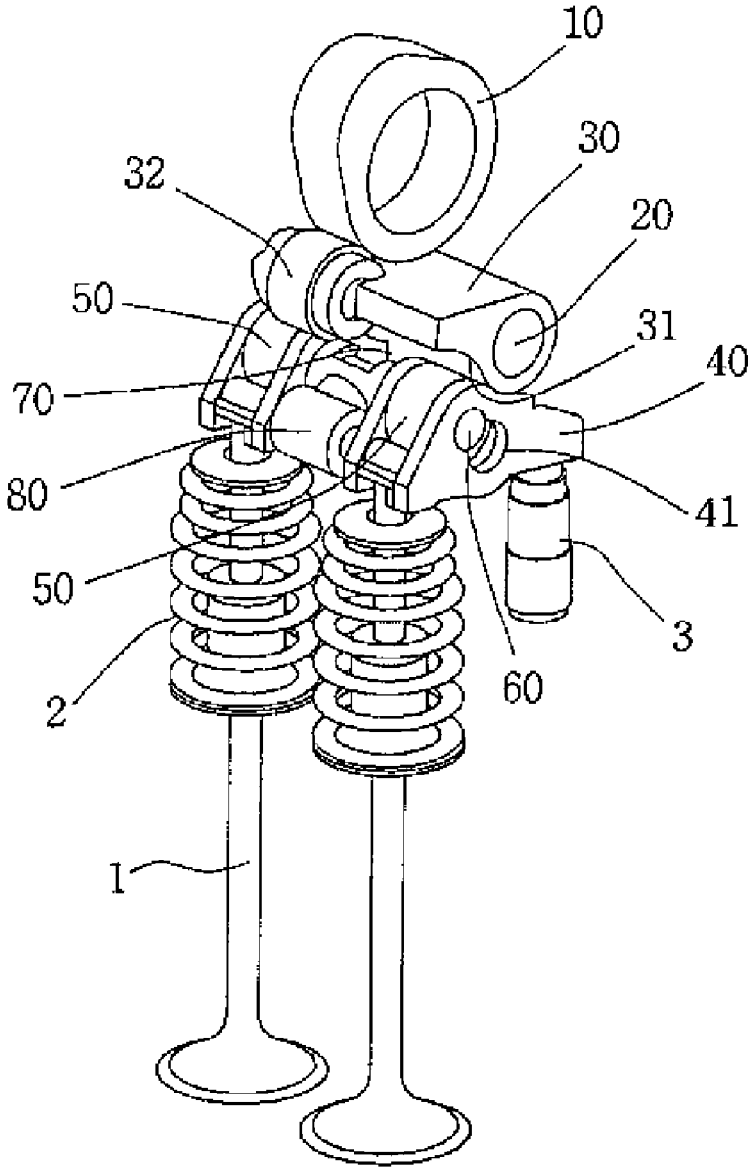
FIG. 2 is a perspective view of FIG. 1.
Figure 3:
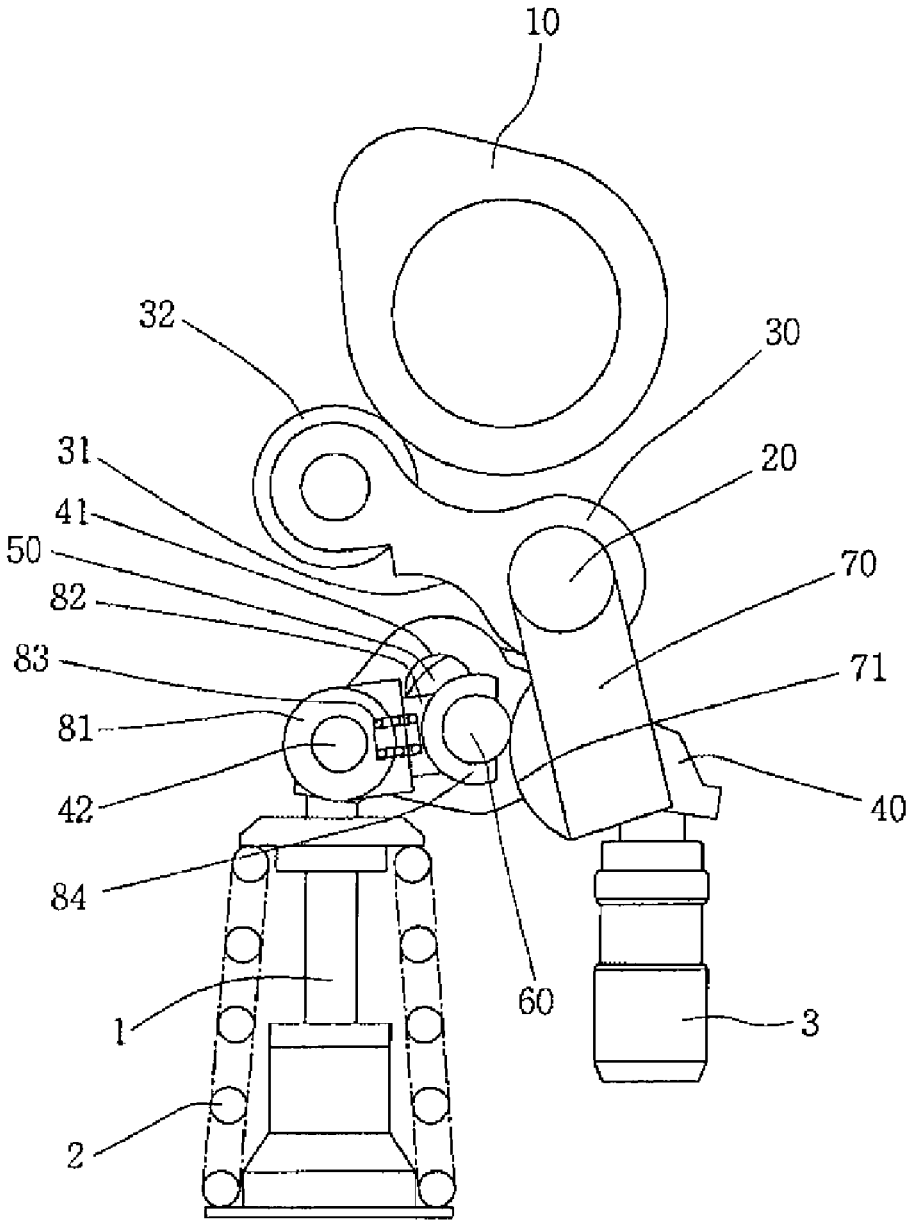
FIG. 3 is a projected view showing the inside of a lower rocker arm, enlarged from FIG. 1.
Figure 4:
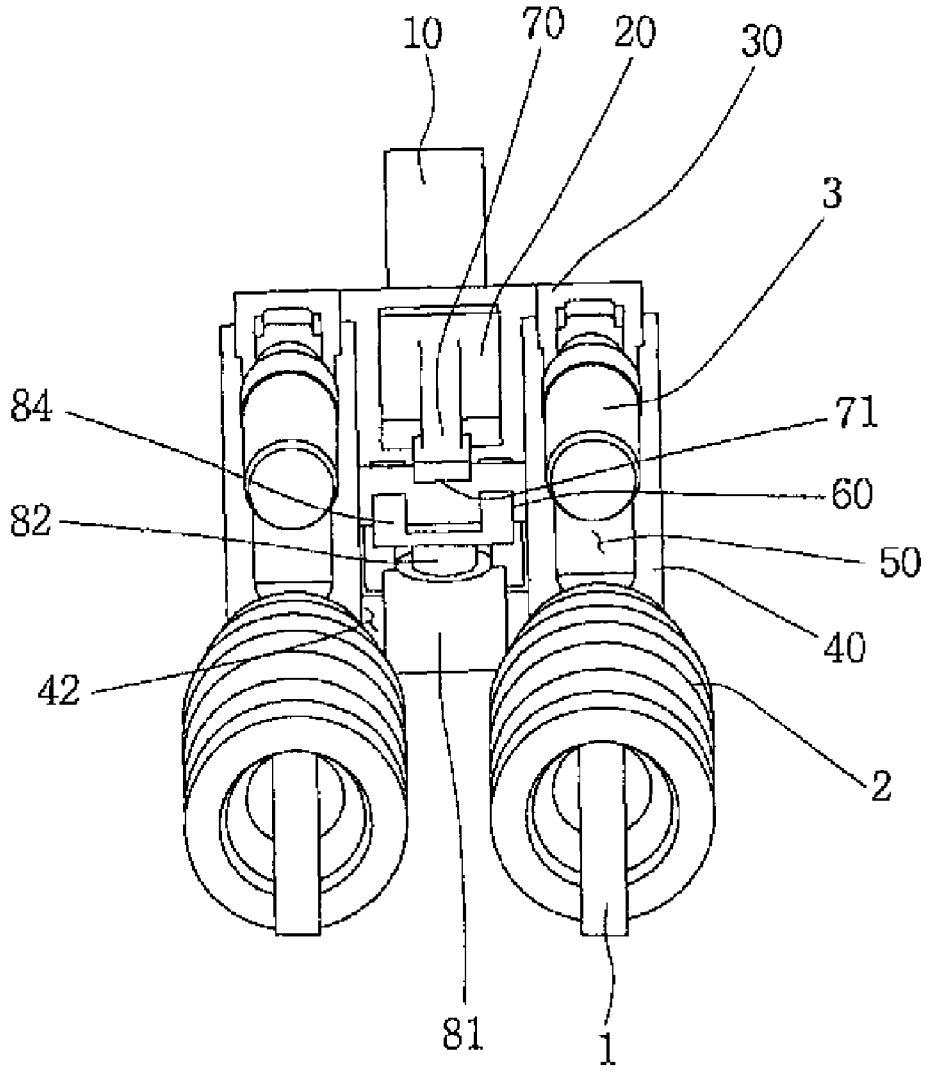
FIG. 4 is a bottom perspective view of FIG. 1.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Referring to FIGS. 1 to 4, a continuously variable valve lift system for an engine includes: a driving cam 10, a control shaft 20, an upper rocker arm 30, lower rocker arms 40, rocker arm followers 50, and a variable mechanism.

Driving cam 10 is formed on a camshaft that rotates while being connected with a crankshaft through a timing belt or a timing chain. Control shaft 20 is rotatably disposed at a predetermined position in a cylinder head. The upper rocker arm 30 is fitted on control shaft 20 and is rotated by driving cam 10. Lower rocker arms 40 are pushed down when upper rocker arm 30 rotates, to push down valves (intake/exhaust valves). Rocker arm follower 50 is fitted in lower rocker arm 40 and contacts with upper rocker arm 30 to transmit the operational force of upper rocker arm 30 to lower rocker arm 40. The variable mechanism changes the position of rocker arm follower 50.

Control shaft 20 is disposed at a predetermined distance under driving cam 10 and of which an end is connected to a motor (step motor generally called CVVL motor), in which control shaft 20 rotates, as an engine control unit (ECU) determines driving conditions and adjusts the operational direction and operational angle of the motor.

One end of upper rocker arm 30 is fitted on control shaft 20 while upper rocker arm 30 and control shaft 20 do not interfere with each other's rotation, such that control shaft 20 can freely rotate with respect to upper rocker arm 30.

The surface, which contacts with rocker arm follower 50, of the lower surface of upper rocker arm 30 is formed in a curved surface that is smoothly connected with the circumference of the one end that is formed in a circular shape formed around control shaft 20. That is, the curved shape and a portion of the circumference of the one end form a contact profile 31 that changes the amount of pushing lower rocker arm 40 according to the point where rocker arm follower 50 contacts.

The other end of upper rocker arm 30 is equipped with a roller 32 coupled by a hinge shaft and roller 32 contacts with driving cam 10. A spring that rotates upper rocker arm 30 to driving cam 10 is provided to keep the contact between roller 32 and driving cam 10. The spring may be a simple coil spring or a coil spring with both end extending and can be disposed in various positions such that it pushes or pulls the other end of the upper rocker arm 30 with respect to the control shaft 20, and the detailed arrangement is not shown in the figures.

When two valves makes a pair (two intake valves and two exhaust valves are used, which is a common configuration that is used in most engines), the contact profile 31 of rocker arm follower 50 formed on upper rocker arm 30 is formed on each of both lower portions and roller 32 is disposed at a protruding portion from the middle portion between the profiles.

This configuration is the same as in lower rocker arm 40, in which lower rocker arms 40 with rocker arm followers 50 are disposed over each valve 1, and both lower rocker arms are connected through a connecting shaft 42.

Lower rocker arm 40 is disposed close to the lower portion of upper rocker arm 30, and of which an end is supported by a hydraulic lash adjuster 3 (HLA) and the other end contacts with the tip of the stem of the valve 1.

Valve 1 is provided with a return spring 2 to return to the initial position after operating (opening).

An inclined slot 41 is formed through lower rocker arm 40, rocker arm shaft 60 is disposed with both ends inserted in inclined slots 41 of both lower rocker arms 40, and rocker arm follower 50 is rotatably fitted on rocker arm shaft 60.

Rocker arm shaft 60 can move up/down in inclined slots 41.

Inclined slot 41 is formed such that the upper portion is further from the center of control shaft 20 than the lower portion.

Rocker arm follower 50 is a kind of roller and a plurality of needle bearings 51 are provided between rocker ram followers 50 and rocker arm shaft 60 such that rocker arm followers 50 freely rotate, maintaining rolling contact with small friction.

The variable mechanism, which is provided to change the position of rocker arm followers 50 in inclined slots 41, is composed of a control lever 70 fitted on control shaft 20 and a variable arm 80 fitted on the middle portion of connecting shaft 42 of lower rocker arms 40.

Control lever 70 may be formed in a variety of ways, for example, may be integrally formed with control shaft 20 or formed as a separate object and then welded.

Alternatively, it is possible to make a hole with spline through the upper end portion of control lever 70 and insert control shaft 20 into the hole to be locked by the spline. However, control shaft 20 and control lever 70 should integrally rotate at the same angle when control shaft 20 is rotate by the motor while interfering with each other's rotation.

Variable arm 80 is disposed to connect rocker arm shaft 60 with connecting shaft 42 of lower rocker arms 40.

Variable arm 80 has a fixing end 81 that is rotatably fitted on connecting shaft 42 and a movable member 82 that is rotatably fitted on rocker arm shaft 60, in which movable member 82 can reciprocate through fixing end 81.

In various embodiments of the present invention, the movable member 82 is telescopically coupled to the fixing end 81. Accordingly, the entire length of variable arm 80 is variable by reciprocation of movable member 82. A spring 83 is disposed between the one end 81 and movable member 82, such that spring 83 is compressed as movable member 83 is pushed into one end 81, and the compressed spring applies a force to push movable member 82 outside. An arc-shaped holding portion 84 is formed on the end of the movable member 82 facing control lever 70 and rocker arm shaft 60 is placed in holding portion 84 such that they can rotate with respect to each other.

Control lever 70 extends downward from control shaft 20 and has an arc-shaped protruding surface 71 on a side facing rocker arm shaft 60, at the lower portion of the body. Protruding surface 71 directly contacts with rocker arm shaft 60 through the opening of holding portion 84 to push rocker arm shaft 60 when control shaft 20 rotates.

The operation of various embodiments is described hereafter with reference to FIGS. 5 to 8.

Figure 5:
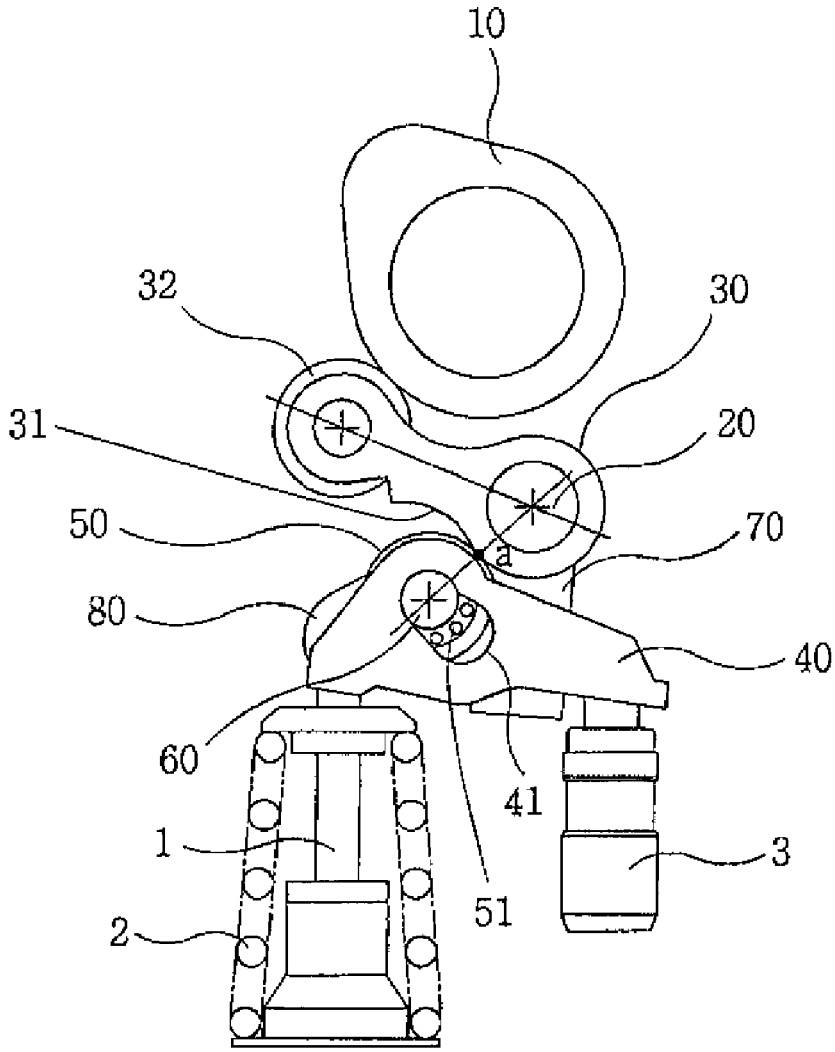
FIGS. 5 and 6 are a front view and a perspective view illustrating an exemplary high-lift operation according to the present invention.
Figure 6:
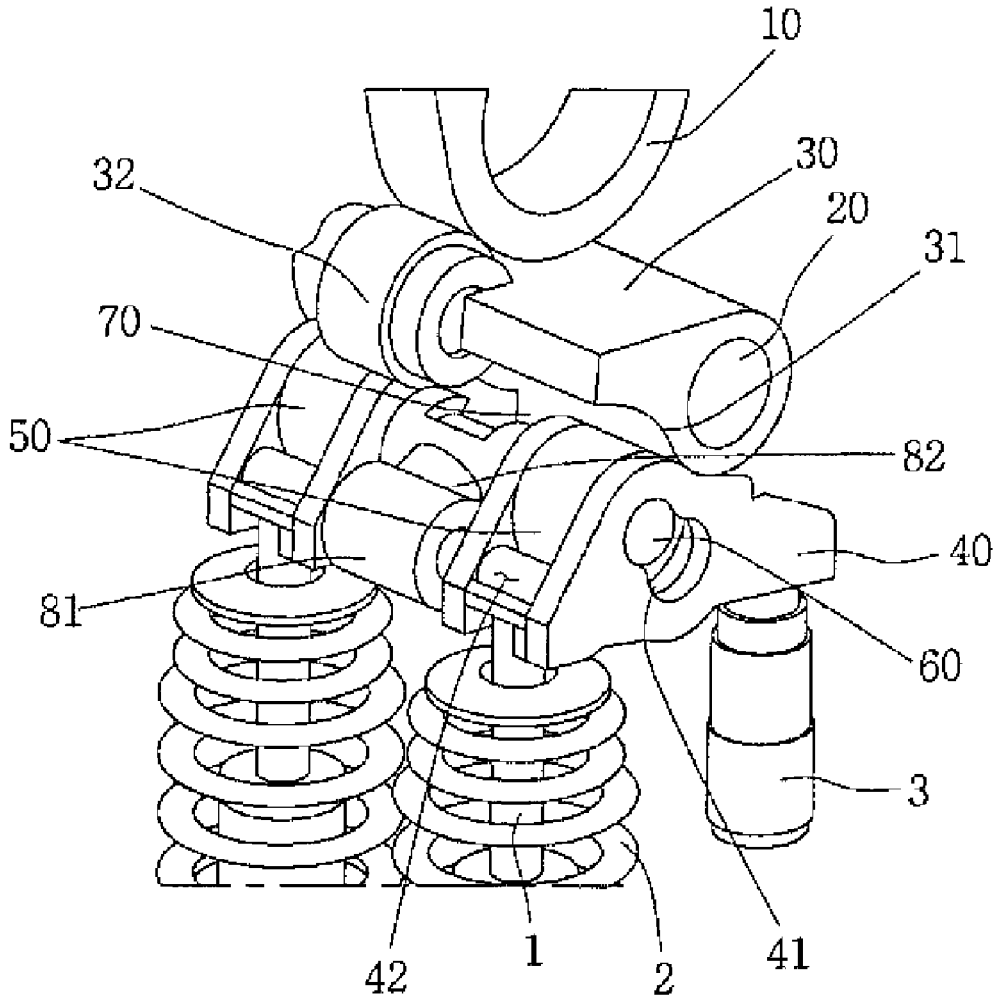

FIGS. 5 and 6 illustrate a high lift in which a valve lift is the maximum, in which control shaft 20 has been rotated clockwise by the motor.

Therefore, as control lever 70 rotates clockwise together with control shaft 20, rocker arm shaft 60 is pushed up to the upper portions of inclined slots 41 and rocker arm follower 50 moves up to a contact point 'a'. The point 'a' is a high-lift operation start position. Further, protruding surface 71 more smoothly pushes up rocker arm follower 50 according to the arc shape.

As rocker arm shaft 60 movers up along inclined slots 41, the distance from connecting shaft 42 decreases and variable arm 80 is shortened while movable member 82 is inserted into one end 81 and spring 83 is compressed. In this configuration, the relative distance between the connecting shaft 42 and the control shaft 20 is increased. Accordingly the vertical distance between the connecting shaft 42 and the control shaft 20 is also increased to form the high lift mode.

As driving cam 10 rotates (the driving cam rotates counterclockwise) in the above position, roller 32 moves down and upper rocker arm 30 rotates counterclockwise (downward) about the center of control shaft 20. Accordingly, rocker arm followers 50 are pushed down and lower rocker arms 40 are correspondingly pushed down, and as a result, valve 1 is pushed and the intake/exhaust ports are opened.

The contact point between rocker arm follower 50 with upper rocker arm 30 moves along contact profile 31 of upper rocker arm 30 to roller 32, in which the operation start point 'a' of rocker arm follower 50 is at the highest position. Therefore, the pushed amount by upper rocker arm 30 when driving cam 10 rotates becomes the maximum and the operating amount of lower rocker arm 40 becomes the maximum, such that the high lift in which the valve lift is the maximum is achieved.

Figure 7:
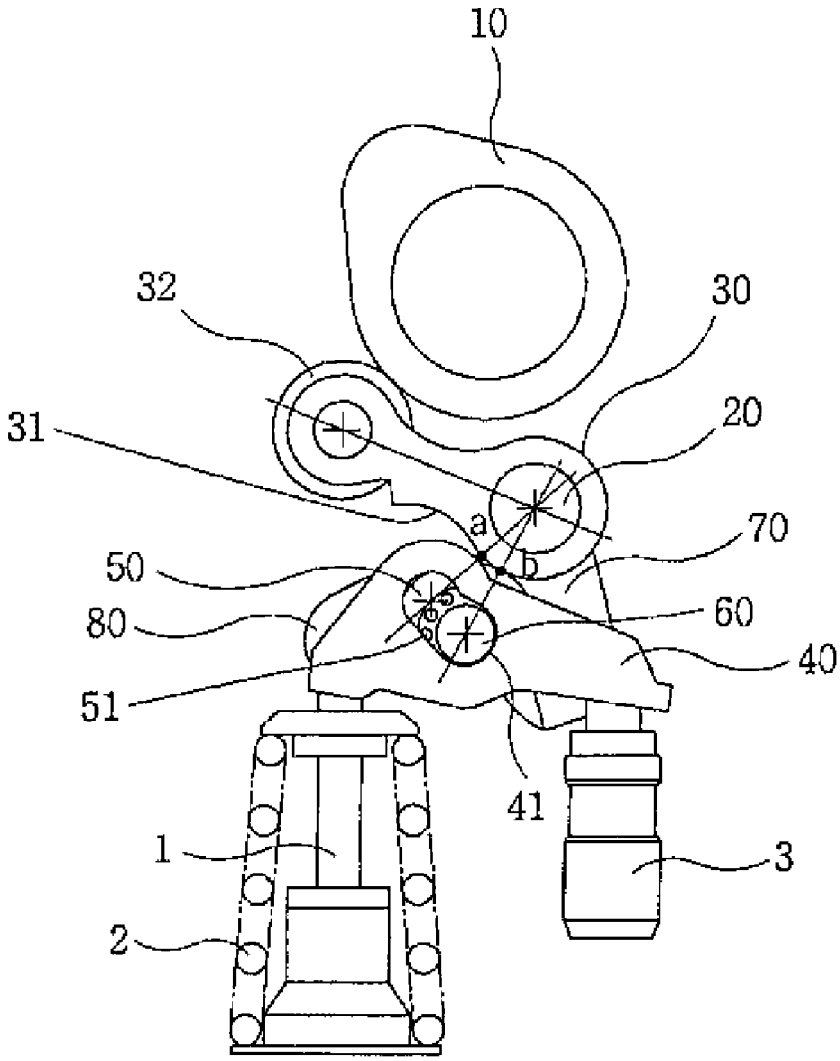
FIGS. 7 and 8 are a front view and a perspective view illustrating an exemplary low-lift operation according to the present invention.
Figure 8:
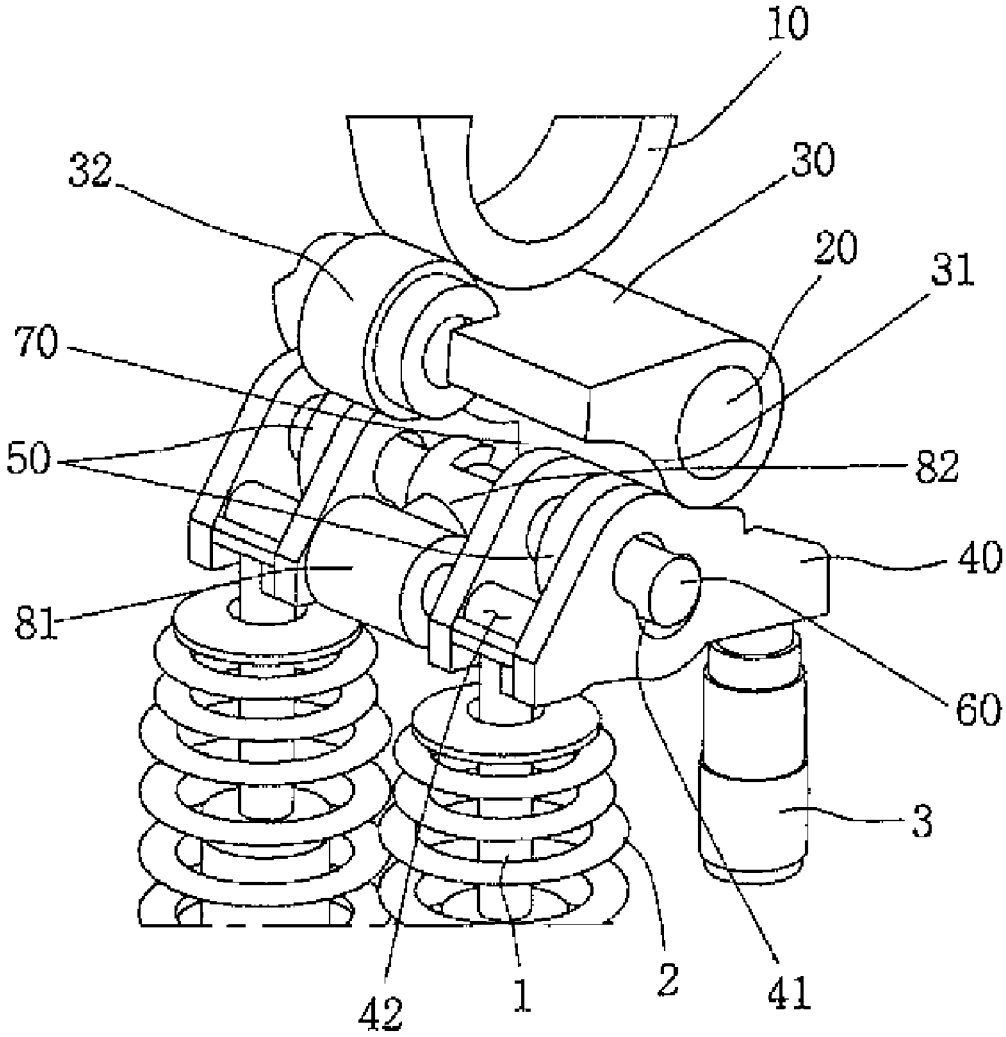

FIGS. 6 and 7 illustrate a low lift in which the valve lift is the minimum, in which control shaft 20 has been rotated counterclockwise from the high-lift position by the motor.

After control shaft 20 rotates as described above, control shaft 20 does not support rocker arm shaft 60 anymore, such that movable member 82 is pushed out of one end 81 by a return force of spring 83, which has been compressed, and pushes rocker arm shaft 60. As a result, rocker arm shaft 60 moves down along inclined slots 41.

Accordingly, the contact point 'a' between rocker arm followers 50 with upper rocker arm 30 moves down to a point 'b'. In this configuration, the relative distance between the connecting shaft 42 and the control shaft 20 is decreased. As a result the vertical distance between the connecting shaft 42 and the control shaft 20 is also decreased to form the low lift mode.

Therefore, even though upper rocker arm 30 is rotated downward at the same angle by rotation of driving cam 10, a low lift, in which the operating amount of lower rocker arm 40 is the minimum as compared with the high lift shown in FIGS. 5 and 6, is achieved.

Therefore, the engine control unit achieves a desired valve lift between the high lift and the low lift, by appropriately changing rotational position of control shaft 20, depending on changes in working conditions of the engine. Further, the valve duration is changed by change of the valve lift.

As described above, the present invention can provide a continuously variable valve lift system for an engine that can be simply operated because it has a small number of components, and has good braking performance by improving operational precision and reliability.

Further, it is easy to maintain the durability, for the same reasons.

Further, since the system is compact and disposed under the camshaft, it is possible to reduce entire size of the engine by reducing total height of the cylinder head and improve free of layout of the engine compartment.

For convenience in explanation and accurate definition in the appended claims, the terms "upper", "downward" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift system for an engine, comprising:

a driving cam fixed to a camshaft;

a control shaft disposed in parallel to the camshaft with a predetermined distance;

an upper rocker arm, one end of which is rotatably coupled to the control shaft and the other end of which is slidably contacted to and rotated by the driving cam;

lower rocker arm that is selectively pushed by the upper rocker arm and selectively pushes a valve;

rocker arm follower slidably coupled to the lower rocker arm and contacting the upper rocker arm, wherein the rocker arm follower transmits an operational force of the upper rocker arm to the lower rocker arm; and a variable mechanism that changes contact point of the rocker arm follower and the upper rocker arm according to rotation of the control shaft.

2. The continuously variable valve lift system for an engine as defined in claim 1, wherein the other end of the upper rocker arm is elastically supported toward the driving cam by an elastic member.

3. The continuously variable valve lift system for an engine as defined in claim 1, wherein the other end of the upper rocker arm is equipped with a roller.

4. The continuously variable valve lift system for an engine as defined in claim 1, wherein the control shaft is disposed between the driving cam and the lower rocker arm.

5. The continuously variable valve lift system for an engine as defined in claim 1 wherein the control shaft is fastened to and activated by an actuator controlled by a control unit to adjust rotational angle of the control shaft.

6. The continuously variable valve lift system for an engine as defined in claim 1, wherein a profile determining a high lift and a low lift according to contact with the rocker arm follower is formed on lower surface of the upper rocker arm.

7. The continuously variable valve lift system for an engine as defined in claim 1, wherein the variable mechanism includes:

a control lever, one end of which is fixed to the control shaft and the other end of which pushes the rocker arm follower to change the contact point of the rocker arm follower by operation of the control shaft; and an elastic member that elastically supports the rocker arm follower against the control lever.

8. The continuously variable valve lift system for an engine as defined in claim 7, wherein the elastic member includes a variable arm rotatably coupled to one end of the lower rocker arm and supporting the rocker arm follower in opposite direction of operation direction of the control lever, the one end of the lower rocker arm being rotatably coupled to the valve.

9. The continuously variable valve lift system for an engine as defined in claim 1, wherein the rocker arm follower is rotatably coupled to a rocker arm shaft and the rocker arm shaft is coupled to inclined slot formed through the lower rocker arm so as to permit the rocker arm shaft to move slidably along the inclined slot by the rotation of the control shaft.

10. The continuously variable valve lift system for an engine as defined in claim 9, wherein the inclined slot is configured such that upper portion thereof is aligned near or to an axis connecting an end of the lower rocker arm and the control shaft so as to increase relative distance between the connecting shaft and the control shaft to form a high lift, the one end of the lower rocker arm being rotatably coupled to the valve.

11. The continuously variable valve lift system for an engine as defined in claim 10, wherein lower portion of the inclined slot is offset with a predetermined distance from the axis connecting the end of the lower rocker arm and the control shaft so as to decrease the relative distance between the connecting shaft and the control shaft to form a low lift.

12. The continuously variable valve lift system for an engine as defined in claim 9, wherein the rocker arm follower is a roller that is rotatably fitted around the rocker arm shaft through a bearing.

13. The continuously variable valve lift system for an engine as defined in claim 9, wherein the variable mechanism includes:

a control lever, one end of which is fixed to the control shaft and the other end of which contacts the rocker arm shaft to change position of the rocker arm shaft along the inclined slot by operation of the control shaft so as to change the contact point of the rocker arm follower; and an elastic member that elastically supports the rocker arm shaft against the control lever.

14. The continuously variable valve lift system for an engine as defined in claim 13, wherein the control lever is integrally formed with the control shaft and has an arc-shaped protruding surface, which contacts with the rocker arm shaft.

15. The continuously variable valve lift system for an engine as defined in claim 13, wherein the elastic member includes a variable arm rotatably coupled to the one end of the lower rocker arm and elastically supporting the rocker arm shaft in opposite direction of operation direction of the control lever.

16. The continuously variable valve lift system for an engine as defined in claim 15, wherein the variable arm includes:

a movable member telescopically coupled to the one end of the lower rocker arm, one end of the movable member being rotatably fitted around the rocker arm shaft; and an elastic element is disposed between the one end of the lower rocker arm and the movable member so as to support the movable member toward the protruding surface of the control lever.

17. The continuously variable valve lift system for an engine as defined in claim 16, wherein an arc-shaped holding portion including a receiving portion that holds the control lever therein to maintain contact between the rocker arm shaft and the control lever is formed on the end of the movable member, wherein the rocker arm shaft passes through the arc-shaped holding portion and rotates with respect to the rocker arm shaft.

18. An engine comprising the continuously variable valve lift system for an engine as defined in claim 1.

19. A passenger vehicle comprising the continuously variable valve lift system for an engine as defined in claim 1.

* * * * *